United States Patent [19]

Coles

[11] 3,973,460

[45] Aug. 10, 1976

[54] KEYBOARD TYPE MUSICAL INSTRUMENT

[76] Inventor: Donald K. Coles, 2505 Capitol Ave., Fort Wayne, Ind. 46806

[22] Filed: Sept. 18, 1974

[21] Appl. No.: 507,118

[52] U.S. Cl. ..... 84/1.01; 84/423; 84/451

[51] Int. Cl.[2] ..... G10C 3/12; G10H 1/00

[58] Field of Search ..... 84/1.01, 1.24, 445–449, 84/423, 442, 451

[56] References Cited

UNITED STATES PATENTS

| | | | |
|---|---|---|---|
| 2,484,930 | 10/1949 | Cornelius | 84/1.01 X |
| 2,539,130 | 1/1951 | Grudin | 84/445 UX |
| 3,023,659 | 3/1962 | Bode | 84/445 |
| 3,030,848 | 4/1962 | Wick | 84/445 |
| 3,141,371 | 7/1964 | Coles | 84/448 |
| 3,379,087 | 4/1968 | Weitzner | 84/445 X |
| 3,610,800 | 10/1971 | Deutsch | 84/1.01 |
| 3,674,907 | 7/1972 | Derry | 84/1.01 |
| 3,800,060 | 3/1974 | Hallman, Jr. | 84/1.24 |
| 3,824,325 | 7/1974 | Obayashi et al. | 84/1.01 |
| 3,836,909 | 9/1974 | Cockerell | 84/1.01 X |
| 3,845,685 | 11/1974 | Coles | 84/451 |
| 3,865,004 | 2/1975 | Coles | 84/423 |

*Primary Examiner*—L. T. Hix
*Assistant Examiner*—Stanley J. Witkowski

[57] ABSTRACT

The instrument is designed to play a six tone scale on its lower digitals, which leads naturally to a simple and easily learned system of music notation. In the preferred embodiment, the six tone scale consists of the first six tones of the conventional diatonic scale, which is called the hexachord scale. For most advantageous use of the instrument, music should be written in or translated into the hexachord notation, but the improved instrument can also be used to play conventionally written music. The hardware to make this possible includes a scale selector switch to translate from a hexachord scale into the conventional diatonic scale. An absolute pitch selector switch is provided, to allow the player to control absolute pitch of the musical output independently of the written music.

3 Claims, 6 Drawing Figures

KEYBOARD TYPE MUSICAL INSTRUMENT

BACKGROUND OF THE INVENTION

1. Field of the Invention

My musical instrument employs a special keyboard and connections therefrom, including a scale selecting switch.

2. Description of the Prior Art

I have described an organ with a hexachord keyboard in my copending U.S. patent application Ser. No. 486,973, filed July 10, 1974, and now U.S. Pat. No. 3,865,004.

Use of the hexachord keyboard helps children to acquire an appreciation of music, particularly if they are encouraged to experiment and improvise simple melodies and harmonies. Elimination of a semitonal interval from the diatonic scale decreases the likelihood of getting unwanted pitch combinations and greatly increases the ability to pick out a tune. This approach, attempted on the traditional keyboard, is marred by the danger of hitting the wrong digital, with its distracting influences. The danger is reduced on my simplified keyboard which has only six lower digitals per octave span.

When children are learning sight reading, they become confused by the traditional musical notation which sometimes represents a particular tone on a line of a staff, and at other times in a space between the lines. More confusion is caused when playing on the treble staff is transferred to the bass staff, where the lines and spaces are differently labeled.

Any six tone musical scale leads naturally to a simple notation compatible with five-line staves, which we may give the generic name hexatonic notation. In hexatonic notation, three of the notes are always assigned to lines, the other three notes are always assigned to spaces. Moreover, the labeling of the lines and spaces in the upper five-line staff is the same as the labeling in the lower five-line staff.

Starting in the past century, there has been interest in the whole tone scale, which has six tones with a musical interval of two semitones between each pair of consecutive tones in the scale. This scale has its special virtues but also disadvantages, and no attempt to promote the whole tone keyboard has been widely accepted. Since the tones of the whole tone scale are uniformly spaced, there is no natural basis for development of loyalty to a particular tone. Furthermore, the whole tone scale lacks the muscial intervals of fourths and fifths which are basic to the early development of music appreciation.

For teaching music to beginners, I have found that the hexachord scale is an improvement over the whole tone scale. The hexachord's "irregularity" serves as a focal point in tonal development, and the hexachord scale includes intervals of fourths and fifths. In my hexachord notation, tones corresponding to lines of the staff constitute the C major triad; tones corresponding to the spaces constitute the D minor triad.

While hexachord notation eases the introduction of children to music, an organ pupil who has been trained in the hexachord system finds that at the present time, most organ music is written in the seven note notation and with one of 14 different key signatures. In order to play this large mass of printed music, accumulated over many years, it would seem that the organ pupil must undergo an arduous extension of his previous training. My improved organ is designed to ease this difficulty.

SUMMARY OF THE INVENTION

My invention is an improvement on a keyboard-type musical instrument such as an organ or electric piano which is specially adapted to play a hexachord scale on the lower digitals. The keyboard contains six lower digitals per octave span, where the length of an octave span is defined as the center-to-center distance between two digitals which control tones an octave apart. The number of upper digitals per octave span is also six, the upper digitals alternating with the lower digitals.

The improvement allows the player trained on the hexachord instrument to play also music written in the conventional diatonic scale. The improvement is a combination of the hexatonic keyboard with a scale selector switch of a type disclosed in my U.S. Pat. No. 3,141,371. Incorporation of this switch allows traditional music to be played on the lower digitals of the keyboard.

DESCRIPTION OF THE PREFERRED EMBODIMENT

Figure 1:
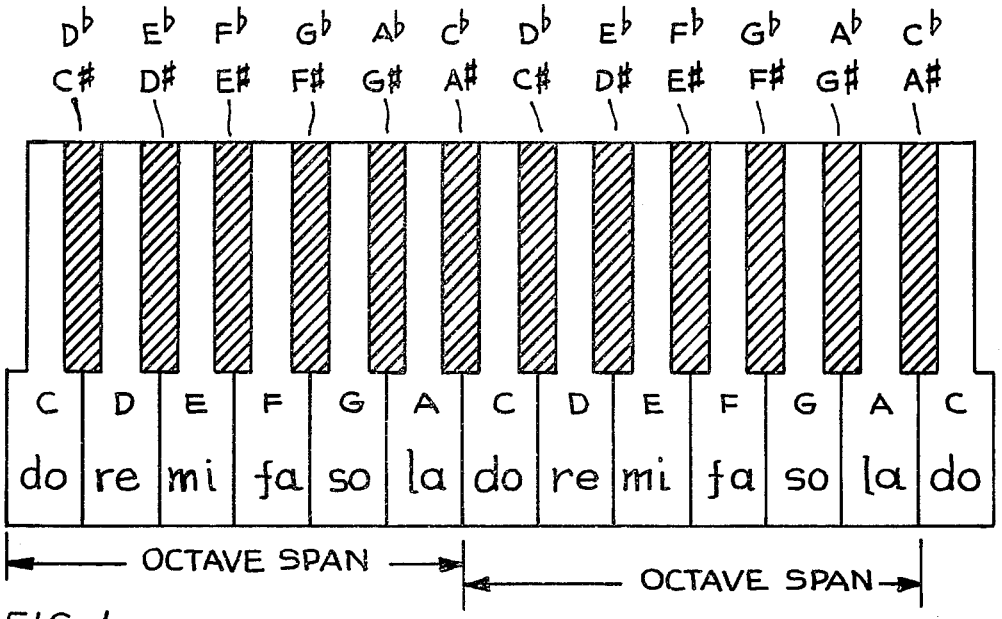
FIG. 1 shows my hexachord keyboard.

Referring to FIG. 1, my hexachord keyboard has six lower digitals per octave span. To avoid ambiguity, I define the octave span as the center-to-center distance between digitals which control tones an octave apart. Although defined as a center-to-center distance, this distance may of course be measured between any corresponding points of the two digitals, or between the cracks to the immediate left or right of the digitals.

Present keyboard instruments employ a 12 tone equitempered scale with twelve different tones per octave span separated by equal musical intervals of a semitone. The traditional keyboard has seven lower digitals and five upper digitals per octave span, with the seven lower digitals playing the major mode of the diatonic scale in the key of C.

In FIG. 1 the six lower digitals to the left play only the first six tones of the major mode of the diatonic scale. These six tones constitute the major mode of the hexachord scale. The musical intervals between adjacent tones, which I call the intertone intervals, are 2-2-1-2-2-3 semitones. These intervals add up to twelve semitones, so that the pitch to the right of the last interval is just one octave higher than the pitch preceding the first interval of the sequence. The next six lower digitals repeat the hexachord scale an octave higher, and so on.

In order to avoid other ambiguities, I generally use the terms "tone" and "pitch" in a relative way to describe a musical sound relative to other tones in a musical scale. When I intend the term pitch in an absolute sense, I use the specific term "absolute pitch." A musical scale is characterized by the intertone intervals between its tones, not by their absolute pitch. The number of intertone intervals in a scale is equal to the number of tones in the scale, the last intertone interval being measured between the highest tone of the scale and an exterior tone which is one octave above the lowest tone of the scale.

Figure 2:
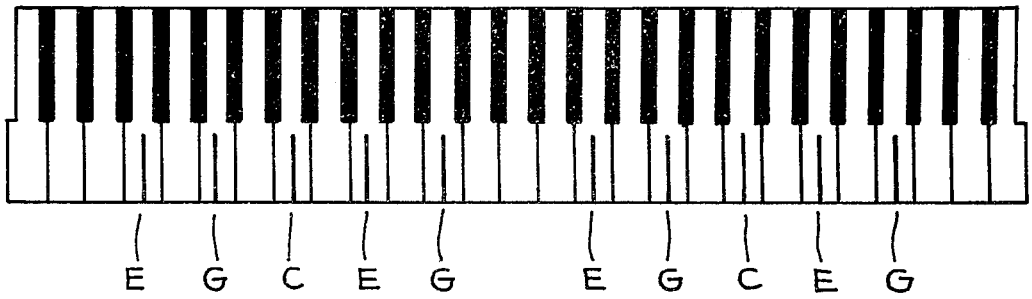
FIG. 2 shows lines painted on the keyboard to represent the lines of the upper and lower staves, with hexatonic notation for the digitals marked by those lines.

I reserve the term "note" for the symbol itself (such as C or D) which is used to specify a digital and the tone it activates. When a staff is used to record music on paper or blackboard, each musical tone is indicated by a note on the staff. Starting at the left of the hexachord keyboard in FIG. 1, the six lower digitals included in an octave span are labeled C,D,E,F,G,A. The notes C,E,G always fall on lines of the upper and lower staves, the notes D,F,A always fall on spaces between the lines. FIG. 2 shows five-line groups painted on the lower digitals to serve as landmarks directly representative of the five line staves.

Figure 3:
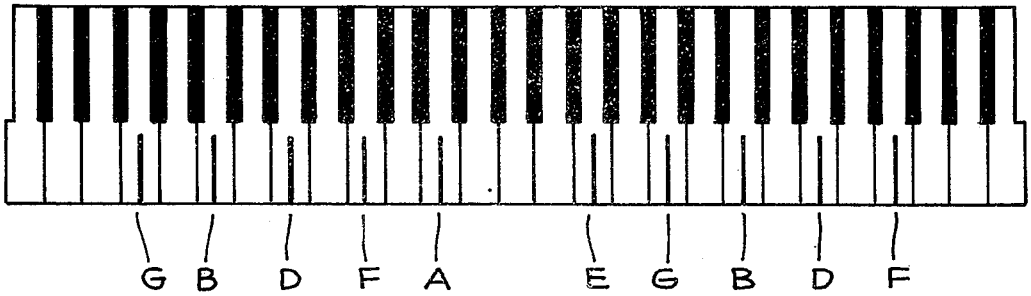
FIG. 3 shows the traditional notation for digitals of the same keyboard.

The traditional system of notation, shown in FIG. 3, has the serious disadvantage that each note is positioned on both lines and spaces. Furthermore, it is positioned differently in the treble and bass staves. For example, the note E is placed on the bottom line of the treble staff, but also in the fourth space up of the treble staff and the third space up on the bass staff. Children find this notation confusing; but with my hexachord notation they see a direct correspondence between the position of a note on a staff and the position of its corresponding tone in the musical scale.

With a keyboard containing several octaves of hexachord scale, it is possible to start on six different lower digitals and obtain sequences of intertone intervals of 2,2,1,2,2,3 semitones, 2,1,2,2,3,2 semitones, 1,2,2,3,2,2 semitones, 2,3,2,2,1,2 semitones, 3,2,2,1,2,2 semitones, and 2,2,3,2,2,1 semitones. I include all six of these sequences as different modes of the same hexachord scale. The first of the above modes corresponds to the tones do,re,mi,fa,so,la of the diatonic scale, and is used as a basis for the system of notation of FIG. 1. The last of the above modes is obtained by extracting the tones do,re,mi,so,la,ti of the diatonic scale. Since this last mode starts five semitones above the starting point of the first mode, melodies based on this mode would have as keynote the note F in the notation of FIGS. 1 and 2.

Figure 4:
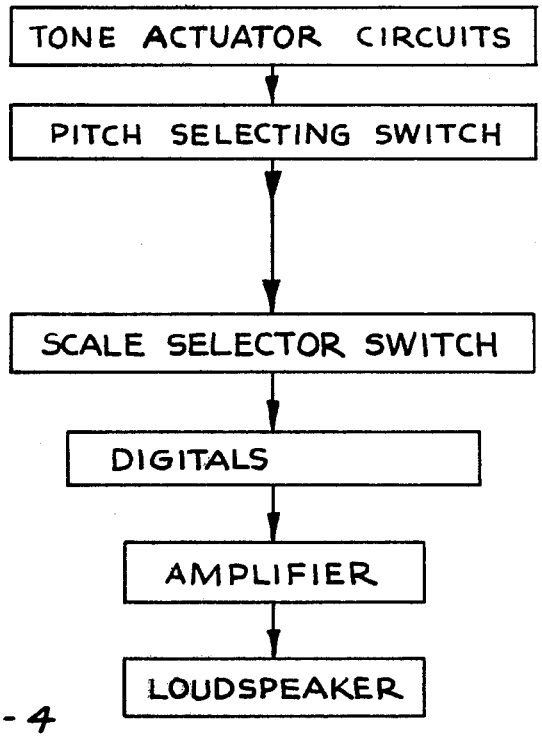
FIG. 4 is a block diagram showing different parts of my instrument.

In the early stages of training in this system, a student uses music written for or translated into the hexachord notation. The hexachord music available is strictly limited, however, and this condition is expected to continue for many years. It is therefore important that a student trained in the hexachord system shall be able to play also the widely available music written in the conventional seven tone system. This is possible with my improved instrument, indicated in block form in FIG. 4. FIG. 4 shows a pitch selector switch and a scale selector switch, both interposed between the tone actuator circuits and the digital switches. The scale selector switch changes the connections to the tone actuator circuits so that either the hexachord scale or the diatonic scale is playable on the lower digitals.

Figure 5:
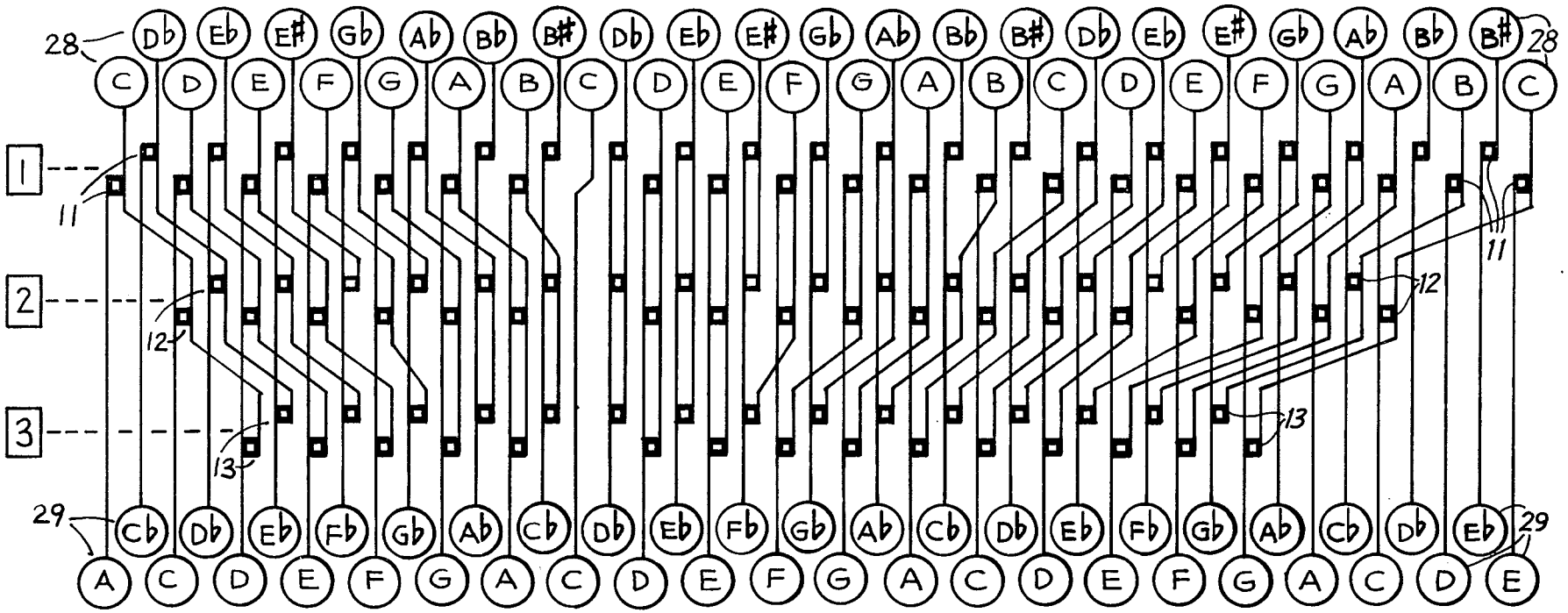
FIG. 5 shows a wiring diagram for my scale selector switch.

Referring to FIG. 4, each digital has at least one digital switch. The digitals, tone actuator circuits, amplifier and loud-speaker are conventional elements; their method of assembly in an organ is well known to the skilled artisan. A wiring diagram for the scale selecting switch is shown in FIG. 5. The pitch selecting switch will be described later.

We refer now to FIG. 5, which is a wiring diagram of my scale selector switch. Tone terminals 28 are identified by the traditional letter labels. Digital terminals 29 are labeled in accordance with the hexachord notation of FIGS. 1 and 2. Pushbuttons 1,2,3, are interlocked so that only one of them can be activated at a time. Pushbutton 1 closes the array of switch contacts 11, pushbutton 2 closes an array of contacts 12, and pushbutton 3 closes an array of contacts 13.

When pushbutton 1 is activated, digital terminals 29 are connected to tone terminals 28 so that the musical intervals corresponding to successive lower digitals above the C digital are 2,2,1,2,2,2,1 semitones. This is the diatonic scale. When pushbutton 2 is activated, digital terminals 29 are connected to tone terminals 28 so that the musical intervals corresponding to successive lower digitals above the C digital are 2,2,1,2,2,3 semitones. This is the hexachord scale. When pushbutton 3 is activated the lower digitals play the tonal pentatonic scale. This simple scale is helpful when introducing music to children.

For clarity, I show only 43 tone terminals connected to 43 digital terminals. It can be seen that, when pushbutton 1 of FIG. 5, is activated fourteen tone terminals per octave are connected to fourteen digital terminals per octave span. The two extra tone terminals labeled E Sharp and B Sharp are non-functional if the scale selector tone terminals are connected directly to the tone actuators, as shown in FIG. 4.

When pushbuttons numbers 1 and 2 are separately depressed, the couplings between the digitals and the tone actuator circuits are shown in Tables 1 and 2 respectively. In these tables, the headings of the columns are the traditional labels for the 12 tones of the equitempered scale; the body of the tables identifies the digitals that play those tones in the first and second switch states respectively. Ordinal numbers K are used to identify all the digitals of the keyboard. Since the digital which plays middle C is the same for all positions of the scale selector switch, the digital which plays the middle C tone is arbitrarily assigned the ordinal number K=50 in both Table 1 and Table 2.

In the first switch state, obtained by depressing pushbutton one, the diatonic scale is played on the lower digitals. Table 1 shows that lower digitals labeled 52,54,56,58,60 and 62 play pitches respectively two, four, five, seven and nine and 11 semitones above the middle C tone. On the other hand, upper digitals labeled 51,53, 57,59 and 61 play pitches respectively one, three, six, eight, and 10 semitones above the middle C tone.

Table 1

| 1 | 2 | 3 | 4 | 5 | | 6 | 7 | 8 | 9 | 10 | 11 | 12 | |
|---|---|---|---|---|---|---|---|---|---|---|---|---|---|
| C | D♭ | D | E♭ | E | | F | G♭ | G | A♭ | A | B♭ | B | |
| 78 | 79 | 80 | 81 | 82 | 83 | 84 | 85 | 86 | | | | | |
| 64 | 65 | 66 | 67 | 68 | 69 | 70 | 71 | 72 | 73 | 74 | 75 | 76 | 77 |
| 50 | 51 | 52 | 53 | 54 | 55 | 56 | 57 | 58 | 59 | 60 | 61 | 62 | 63 |
| 36 | 37 | 38 | 39 | 40 | 41 | 42 | 43 | 44 | 45 | 46 | 47 | 48 | 49 |

Table 1-continued

| | | | | | | | | | | | | | |
|---|---|---|---|---|---|---|---|---|---|---|---|---|---|
| | | | | 26 | 27 | 28 | 29 | 30 | 31 | 32 | 33 | 34 | 35 |

Table 2

| 1 | 2 | 3 | 4 | 5 | | 6 | 7 | 8 | 9 | 10 | 11 | 12 |
|---|---|---|---|---|---|---|---|---|---|---|---|---|
| C | D♭ | D | E♭ | E | | F | G♭ | G | A♭ | A | B♭ | B |
| 74 | 75 | 76 | 77 | 78 | 79 | 80 | 81 | 82 | 83 | 84 | | 85 |
| 62 | 63 | 64 | 65 | 66 | 67 | 68 | 69 | 70 | 71 | 72 | | 73 |
| 50 | 51 | 52 | 53 | 54 | 55 | 56 | 57 | 58 | 59 | 60 | | 61 |
| 38 | 39 | 40 | 41 | 42 | 43 | 44 | 45 | 46 | 47 | 48 | | 49 |
| 26 | 27 | 28 | 29 | 30 | 31 | 32 | 33 | 34 | 35 | 36 | | 37 |

In the second switch state, obtained by depressing pushbutton number two, the hexachord scale is played on the lower digitals. Table 2 then shows that lower digitals labeled 52,54,56,58 and 60 play pitches respectively two, four, five, seven and nine semitones above the middle C tone. On the other hand, upper digitals labeled 51,53,57,59 and 61 play pitches respectively one, three, six, eight and 11 semitones above the middle C tone.

Referring to Table 1, when pushbutton number one is depressed, digitals 55 and 63 are decoupled but both may be functional in other modes of the diatonic scale. Referring to Table 2, when pushbutton two is depressed, the B Flat tone actuator and digital 55 are both decoupled, but both may be functional in other arrangements of the hexachord scale.

Referring to Table 1, digital 52 plays the D tone one octave below the D tone played by digital 66. More generally, each digital labeled by ordinal number K plays a pitch one octave below that pitch played by digital labeled K+14. This is because there are fourteen digitals per octave span when playing the diatonic scale. Referring to Table 2 which corresponds to the second switch state, each digital labeled K plays a pitch one octave below that pitch played by digital labeled K+12. This is because there are 12 digitals per octave span when playing the hexachord scale.

The headings of Table 1 and 2 correspond to the traditional absolute pitches when the pitch selector of FIG. 4 is in its standard state. In other states of the pitch selecting switch, the headings of Tables 1 and 2 represent relative tones of the movable C major scale.

A scale selecting switch similar to that shown in FIG. 5 was disclosed in my U.S. Pat. No. 3,141,371. It was there used to select between the diatonic scale and the whole tone scale. However, I have found that the hexachord scale is an improvement over the whole tone scale for teaching music to beginners.

Referring again to FIG. 5, tone terminals 28 may be connected directly to the tone actuator circuits, or via other switches, as shown in FIG. 4. The intervention of the absolute pitch selector switch has no effect except to raise or lower the absolute pitch of the musical output.

Figure 6:
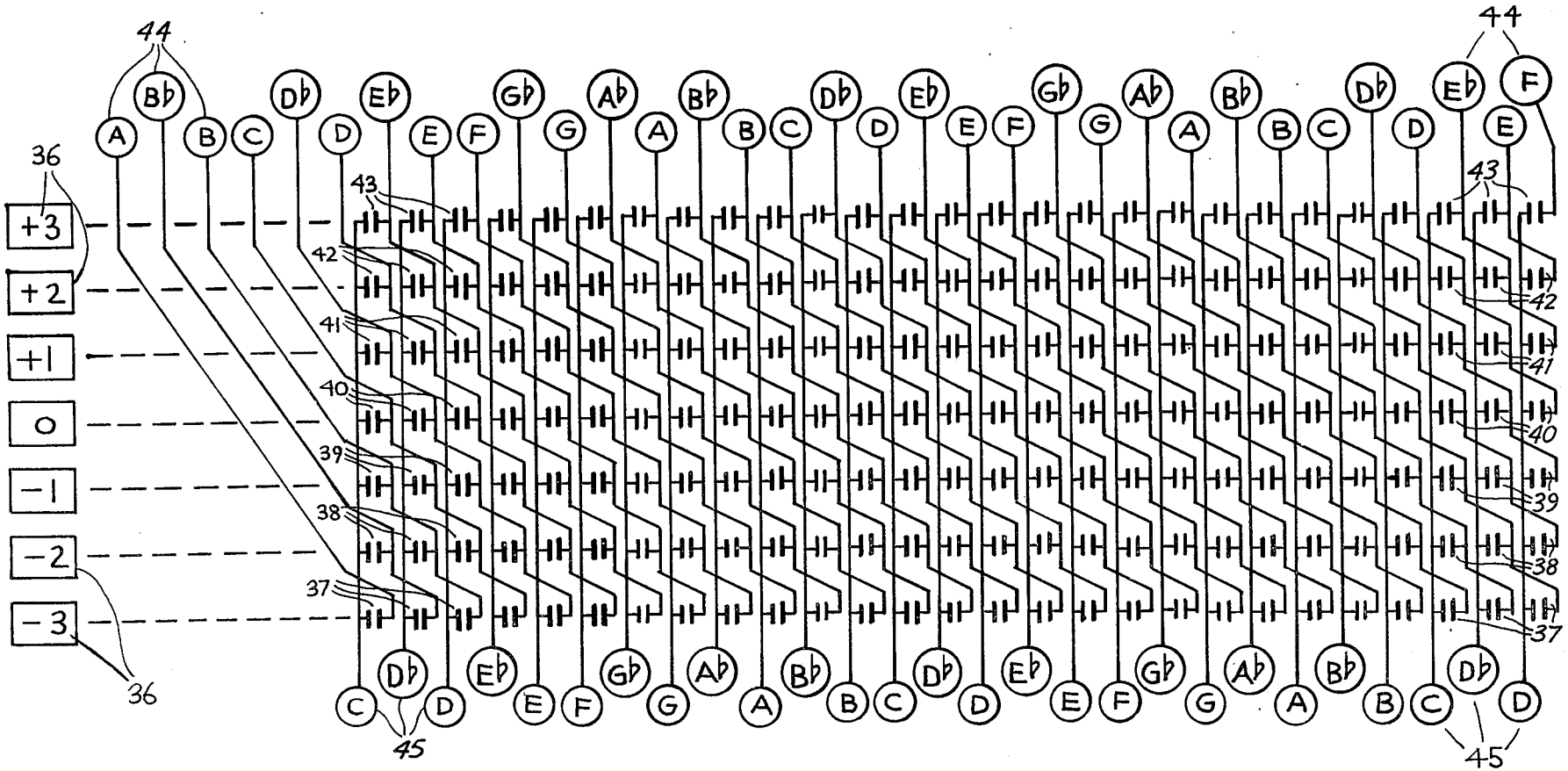
FIG. 6 shows a wiring diagram of an absolute pitch selector switch.

Referring to FIG. 6, showing an absolute pitch selecting switch, both the tone terminals 44 and digital terminals 45 are identified by use of the traditional notation. Pushbuttons 36 are interlocked so that only one of them can be activated at a time. The pushbutton marked 0 closes the array of contacts 40, the pushbutton marked +1 closes the array of contacts 41, and so on. Tone terminals 44 are connected to digital terminals 45 through one of the seven arrays of switches 37 . . . 43. For clarity, I show only 33 tone terminals connected to 27 digital terminals.

When the central array of contacts 40 is closed the C digital terminal is connected to the C tone terminal, the D digital terminal is connected to the D tone terminal, and so on. When the array of contacts 41 is closed, the same digital terminals are each connected to tone terminals which produce absolute pitches one semitone higher. A pitch selecting switch of this type is disclosed in my U.S. Pat. No. 3,141,371.

Operation of the absolute pitch selecting switch does not necessarily affect the naming of the musical tones that result. For example, in FIG. 1, the G digital may be struck, and the resulting tone may be called G regardless of which absolute pitch selector pushbutton is activated. When a pitch selector is available, it is more helpful to describe a tone by its position in the movable C major scale, rather than by its absolute pitch. Of course, the two descriptions coincide when the absolute pitch selector is in its central position.

While my invention has been described with reference to an electric organ, it is applicable to any other electrically keyed musical instrument such as a electronic piano, accordian, or synthesizer. The term "keyboard" is used generically to include the pedalboard or clavier of an organ. The term "digital" includes the pedal. The tones controlled by the upper digitals may be different from those shown for the preferred embodiment. Some of the upper digitals may be omitted from the keyboard. The instrument is not necessarily equipped with an absolute pitch selector.

I claim:

1. In a keyboard musical instrument, apparatus for converting from a diatonic musical scale to an irregular hexatonic scale comprising:

a plurality of tone actuator means respectively arranged to provide a twelve tone scale with 12 equal intertone intervals per octave, each equal to one semitone, a continuous keyboard having a plurality of manually actuated alternately disposed upper and lower digitals, individual digitals being coupled to individual tone actuator means so that when a particular digital is actuated it plays a particular pitch, said digitals labeled in order by consecutive numbers K increasing from left to right on the keyboard, including a central number K = 50 labeling a lower digital which plays a selected pitch, switching means having at least first and second switch states for converting said instrument respectively from a keyboard arrangement containing fourteen digitals per octave span to a keyboard arrangement containing twelve digitals per octave span, in said first switch state, any seven consecutive lower digitals playing pitches of the diatonic scale, each digital labeled K playing a pitch one octave below that pitch played by a digital labeled K+14, lower digitals labeled 52, 54, 56, 58, 60, and 62 playing pitches respectively two, four, five, seven, nine and 11 semitones above said selected pitch, upper digitals labeled 51, 53, 57, 59, 61 playing pitches respectively one, three, six, eight and 10 semitones above said selected pitch, in said second switch state, any six consecutive lower digitals playing pitches of a predetermined six tone scale which is derived from said diatonic scale by the omission of one of its seven tones, upper digitals playing intermediate pitches, digitals labeled K playing pitches one octave below those pitches played by digitals labeled K+12.

2. The apparatus of claim 1 in which:

in said second switch state, lower digitals labeled 52, 54, 56, 58 and 60 activate pitches respectively two, four, five, seven and 9 semitones above said selected pitch.

3. The apparatus of claim 2 in which:

in said second switch state, upper digitals labeled 51, 53, 57, 59 and 61 play pitches respectively one, three, six, eight and 11 semitones above said selected pitch, upper digital labeled 55 is decoupled from said tone actuator means.

* * * * *